US008661598B2

(12) United States Patent
Alshehhi

(10) Patent No.: US 8,661,598 B2
(45) Date of Patent: Mar. 4, 2014

(54) MACHINE TO CLEAN FACADE OF BUILDING

(76) Inventor: Ahmed Ali Ibrahim Alshehhi, Abu Dhabi (AE)

( * ) Notice: Subject to any disclaimer, the term of this patent is extended or adjusted under 35 U.S.C. 154(b) by 311 days.

(21) Appl. No.: 13/079,481

(22) Filed: Apr. 4, 2011

(65) Prior Publication Data

US 2012/0246847 A1 Oct. 4, 2012

(51) Int. Cl.
*A47L 1/02* (2006.01)
*A47L 11/38* (2006.01)

(52) U.S. Cl.
USPC ..... 15/103; 15/50.3

(58) Field of Classification Search
USPC ..... 15/98, 103, 50.3
See application file for complete search history.

(56) References Cited

U.S. PATENT DOCUMENTS

| | | | | |
|---|---|---|---|---|
| 3,080,592 | A * | 3/1963 | Hassage | 15/98 |
| RE36,649 | E * | 4/2000 | Jefferies et al. | 15/50.1 |
| 6,090,221 | A | 7/2000 | Gan et al. | |
| 7,007,334 | B2 | 3/2006 | Thurnher | |
| 2003/0106176 | A1 * | 6/2003 | Wang | 15/50.3 |
| 2006/0048800 | A1 | 3/2006 | Rast et al. | |
| 2009/0044833 | A1 | 2/2009 | Simonette | |

FOREIGN PATENT DOCUMENTS

| | | | |
|---|---|---|---|
| EP | 1084771 | A1 | 3/2001 |
| WO | 2004000088 | A1 | 12/2003 |

OTHER PUBLICATIONS

Torsten Bohme et al., Service Robots for Facade Cleaning, Proceedings of the 24th Annual Conference of the IEEE, Industrial Electronics Society, Aug. 31-Sep. 4, 1998, pp. 1204-1207, vol. 2, Aachen, Germany.

Norbert Elkmann et al., Innovative Service Robot Systems for Facade Cleaning of Difficult-to-Access Areas, Proceedings of the 2002 IEEE/RSJ International Conference on Intelligent Robots and Systems, Oct. 2002, pp. 756-762, vol. 1, Lausanne, Switzerland.

* cited by examiner

*Primary Examiner* — Randall Chin
(74) *Attorney, Agent, or Firm* — Sughrue Mion, PLLC

(57) ABSTRACT

An apparatus for cleaning facades including glass surfaces of high rise buildings. The apparatus includes a machine having a frame for attaching components and equipments of a main unit; a thrust provider for generating force to keep the main unit in contact with the facade; a hoist to enable lifting and lowering of the main unit; a laundry unit comprising a fabric sheet to clean the facade; a roller attached to end of extended arms of the main unit; and a control unit installing electrical controls on the main unit. The machine provides a number of novel elements and safety features by applying simple design concept that is practicable to wide range of buildings of glass or flat façades.

14 Claims, 3 Drawing Sheets

MACHINE TO CLEAN FACADE OF BUILDING

FIELD OF THE INVENTION

The present invention pertains generally to apparatus and methods for cleaning facades of high rising buildings.

BACKGROUND OF THE INVENTION

The number of buildings with large glass or flat facades is increasing all over the world. These facades must be periodically cleaned using manual cleaning which is the conventional method today to clean external surface of high rising building.

Cleaning windows on high rise buildings is both difficult and expensive. Workers utilize the Building Maintenance Unit (BMU) to reach the facade. While the cradle of BMU is moving in front of building's windows, cleaning workers occupying the cradle use sponge and cleaning detergent to wipe clean the facade. This procedure has high risk for the workers and takes weeks to clean the facades of a single high rise structure. The workers sometimes have to perform their work under intense conditions leading risking injury. The method is also messy in operation and is highly sensitive to the weather condition. After cleaning one high rise structure the workers need to move to other side of the building with the equipment making it a laborious and time consuming process.

Apart from the high cost and time for cleaning, another disadvantage of current method is that windows can only be cleaned in longer intervals, and it is not cost effective to wash individual sections of the building even if the need persists. Also as the facade workers are not always a part of Building Maintenance, important information could be seen or leaked during the cleaning process.

Though a few automated or semi-automatic applications exist for cleaning buildings in the market, but have failed due to reasons like; a weak safety concept, poor cleaning quality, requiring additional construction to the facade, expensive initial or operating costs, unable to avoid obstacles such as an open window or minor structural protrusion. Even though some methods have been successful to some extent but are applicable only to a particular building.

Accordingly, a need exists for a window cleaning system that can be operated autonomously and which can be utilized for performing overall periodic cleaning or performing cleaning on an as needed basis. The present invention overcomes the weaknesses of existing systems by simple designing of the machine to clean wide range of high rise building of glass or flat facades.

SUMMARY OF THE INVENTION

An automated facade cleaning system is described that is particularly well-suited for washing the exterior surfaces or glass windows on high rise buildings. The system can be configured for semi-automatic cleaning, or for fully automated remote cleaning operations. Although the bulk of the description herein describes a fully automated system, it will be appreciated that the invention may be implemented without one or more of the inventive aspects described and may thereby require manual intervention when so implemented.

The invented machine is a frame housing electrical and mechanical components referred to as the main unit which can be simply integrated with the existing BMU by replacing BMU's cradle with it. The unit requires electric power supply that can be provided through electric power cable either from the roof of the building or ground underneath it.

In an aspect of the present invention the main unit lifting and lowering is provided by the existing hoist of the BMU that is located on the roof part of the BMU, however on some BMU systems the hoist unit is installed on a cradle, therefore the invented machine has a hoist device which can provide the desired up & down movement.

The surface is cleaned while the main unit is moving in front of the facade, a close loop circuit of micro fabric sheet wipe the facade while resting on a soft or spongy roller attached to extended arms from the main unit.

In an aspect of the present invention thrust providing equipment generates air flow that may provide the necessary pushing force towards the window, thereby keeping the spongy roller and the micro fabric in contact with the surface.

The fabric sheet then enters a laundry chamber where it gets sprayed by high pressure water and/or cleaning solution from nozzles that are directed into fabric sheet to remove the particles. Afterwards, the sheet is run between two or more rollers that are pressed against each other, squeezing most of the water out from the sheet.

In an aspect of the present invention a tray placed under the spraying nozzles and squeezing rollers collects all sprayed and squeezed water wherefrom a small pump sends it to a filtration unit to remove dust, dirt, sand and other particles. The purified water is then sent back to a water reservation tank.

In an aspect of the present invention, the water in the tank is heated by an electrical water heater.

An aspect of the present invention is the ability to accomplish the cleaning task for different types of towers and skyscrapers depending on its construction of the external surface.

Another aspect of the present invention is to allow installing the fully automated facade cleaning system without the need of structural changes to the building.

Another aspect of the present invention is the reduced time of performing the facade cleaning tasks in comparison with the conventional methods and also lower consumption of water for the facade cleaning process.

Since the present invention eliminates direct human interference for facade cleaning it is safer, more reliable and can be operated on a wide range of weather conditions.

Yet another aspect of the present invention is its environmental friendly nature and cost effective solution over the conventional methods without degradation of the cleaning quality.

Further aspect and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

Further features and advantages of the present invention will become apparent from the following detailed description, taken in combination with the appended drawings, in which.

DETAILED DESCRIPTION OF THE INVENTION

Figure 1:
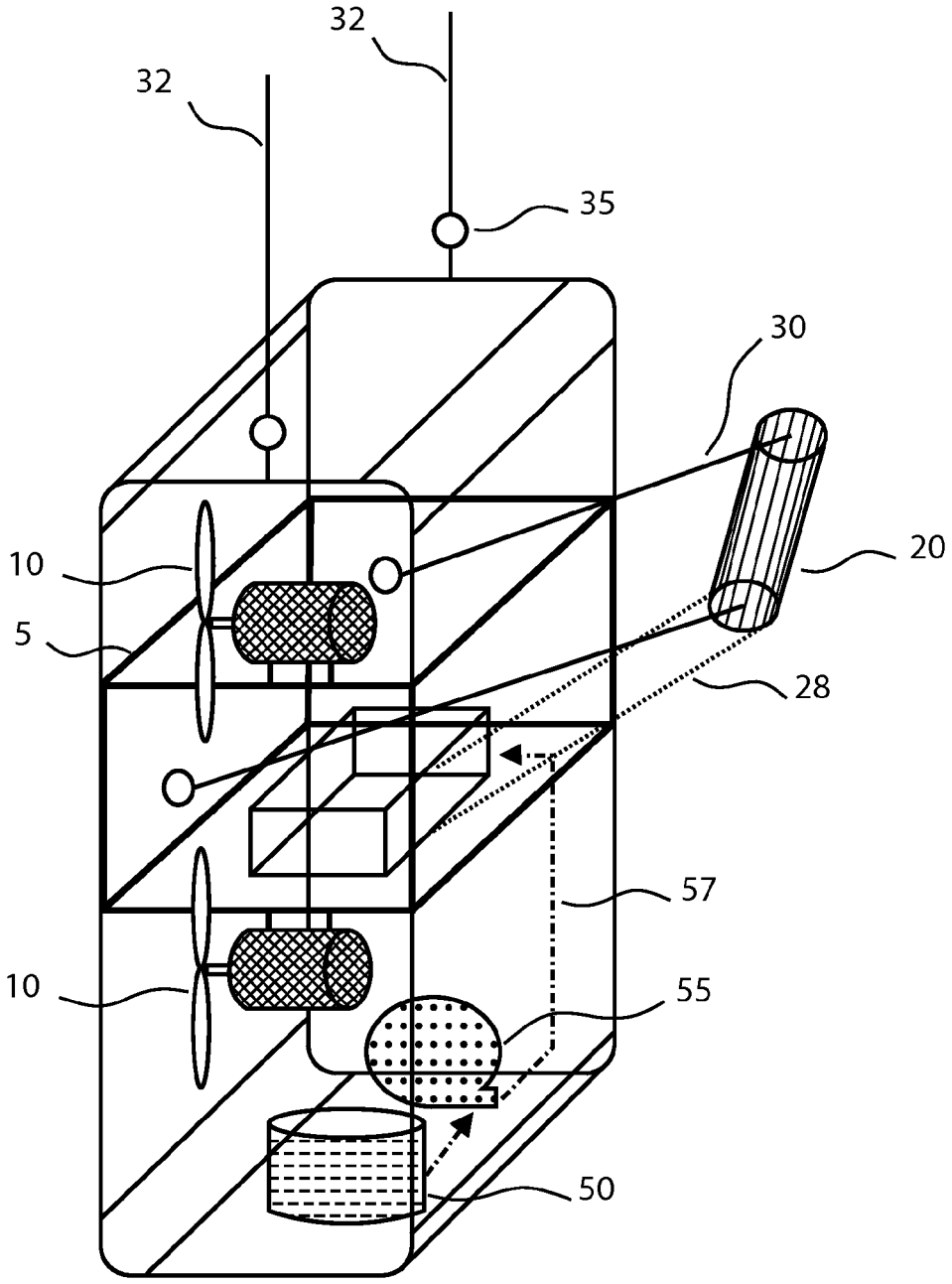
FIG. 1 shows overall the main unit and its metallic structural chassis where all the electrical and mechanical components of the main unit are attached.
Figure 2:
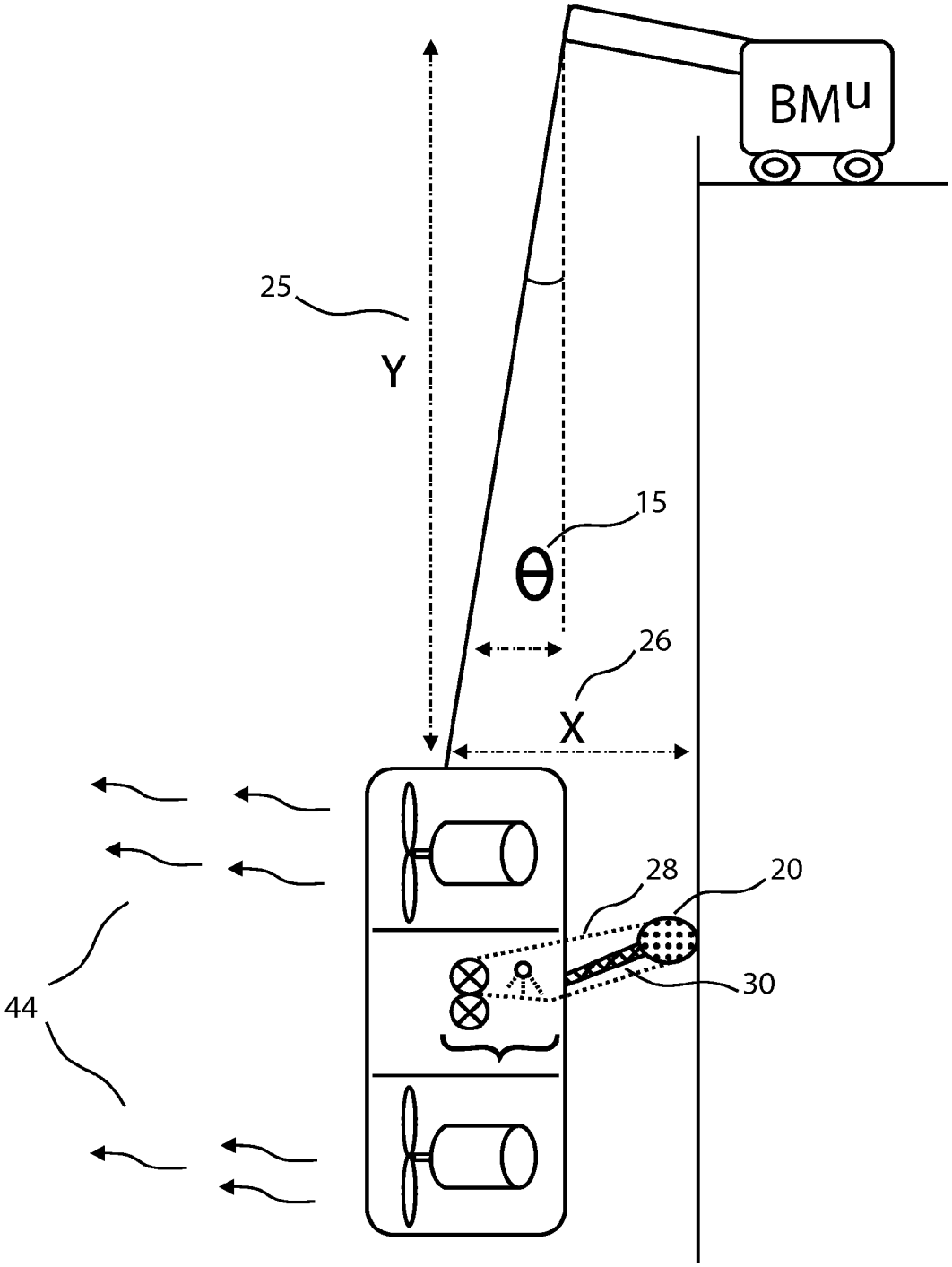
FIG. 2 shows the positioning of the main unit in respect to Façade.
Figure 3:
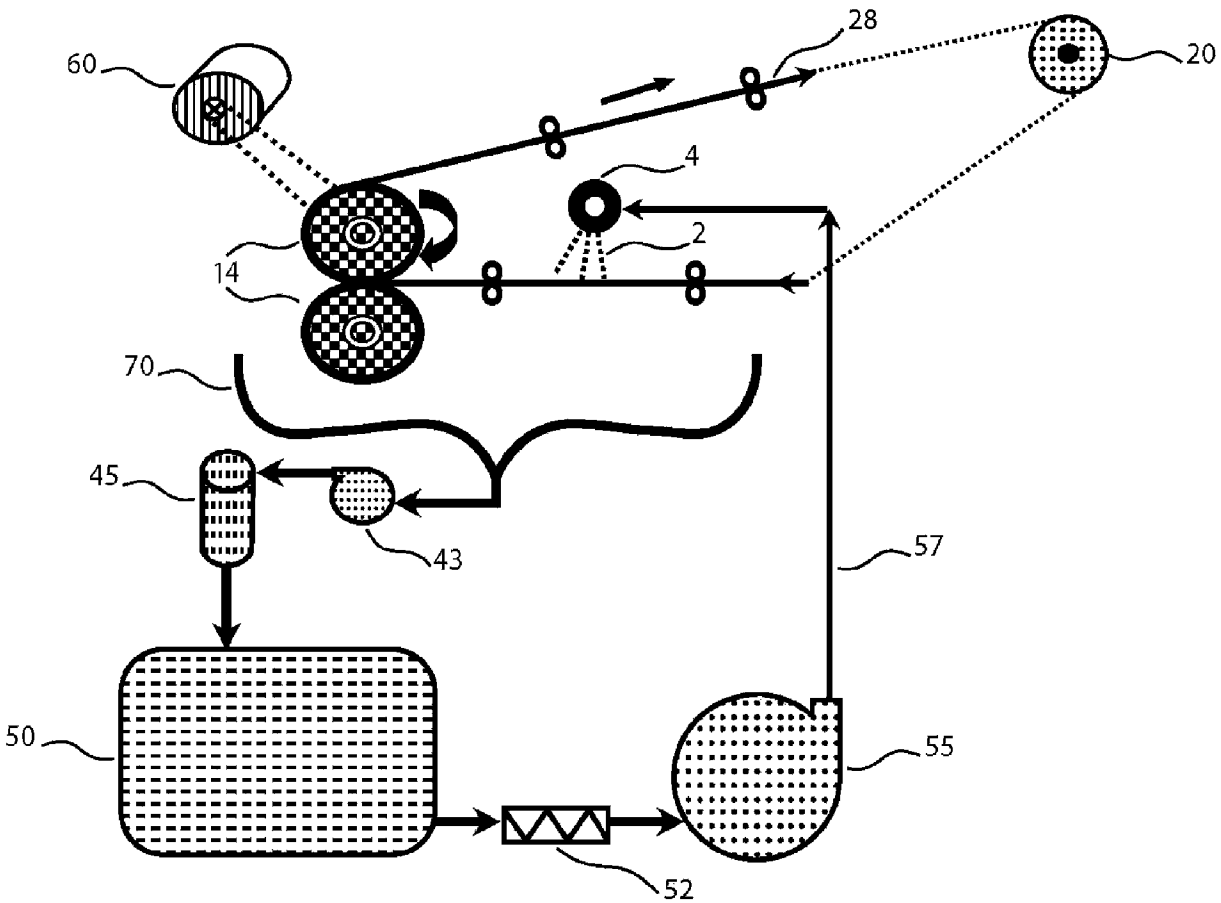
FIG. 3 shows a laundry unit and its accessories.

Referring more specifically to the drawings for illustrative purposes, the present invention is embodied in the method generally described as shown in FIG. 1 to FIG. 3. The following description is presented to enable one of ordinary skill in the art to make and use the invention as provided in the context of a particular application and its requirements. Furthermore, it is to be understood that inventive aspects may be practiced in numerous alternative ways by one of ordinary skill without departing from the teachings of the present invention. Therefore, various modifications to the preferred embodiments will be readily apparent to those skilled in the art, and the principles defined here may be applied to other embodiments. Thus the present invention is not intended to be limited to the embodiments shown below but only by its claims.

The scope of the invention will be pointed out in the appended claims. Furthermore, aspects of the invention may be implemented separately or in various combinations without departing from the teachings of the present invention. Specific embodiments are typically shown having a given set of features for the sake of clarity; however, it will be appreciated that the invention may be implemented with more or fewer aspects without departing from the present invention. Few aspects of the invention may also be replaced by mechanical means without departing from the scope of the present invention.

FIG. 1 shows a metallic structural chassis 5 where all electrical and mechanical components of the main unit are attached and are described in an embodiment of the present invention below.

As shown in FIG. 1, the thrust provider are fans 10 driven by electrical motors. The fans 10 will generate mass of air flow as shown in FIG. 2, element 44 in the opposite direction of the facade. FIG. 1 also shows a soft or spongy roller 20 supported by arms 30 on the structural chassis 5. Wire rope 32 connecting fasteners 35 suspend the main unit from the roof of the building. FIG. 3 shows the close loop of the fabric sheet 28 pass between squeezing rollers 14 of which squeezing rollers 14 are driven by an electrical gear-motor 60. In an embodiment of the invention a high pressure discharge pump 55 is used to discharge, from nozzles 4, water 2 into the fabric sheet 28. The sprayed water 2 discharged from nozzles 4 and water extracted by squeezing rollers 14 are collected by a tray 70. A circulation pump 43 collects the water from tray 70 and sends it to a filtration unit 45 which is then sent to a reservation tank 50.

Thus the thrust provider helps the machine to cling on to the surface of the facade and keep the fabric sheet in direct contact with the facade.

The fabric sheet 28 is a close loop circuit that is rolling between the laundry unit and the facade.

FIG. 2 shows the positioning of the main unit against the facade. The natural pushing force that the cleaning machine applies against the facade is equal to (SIN θ(FIG. 2-15)*the unit weight*gravity (g)). Since the horizontal distance 26 is limited and the height 25 is increasing significantly in comparison to the horizontal distance 26, it results in a very small θ 15 and therefore a little and inadequate pushing force. Hence, the thrust provider is needed to generate sufficient pushing force that will keep the unit with good contact to the surface.

FIG. 3 shows a laundry unit with its accessories. Part of the cloth fabric sheet 28 is contained in the laundry unit. The sheet is washed by pressurized water and/or detergent 2 from nozzles 4 in order to remove particles collected from the facade.

After the initial cleaning of facade the fabric sheet runs in between the squeezing rollers 14 that are pressed against each other squeezing most of the water from it. One of the squeezing rollers 14 is rotated by the electrical gear-motor 60 to provide the movement and pulling force for the fabric sheet 28.

Underneath the squeezing rollers 14 and the sprayed water area is tray 70, which collects the water and sends it to the filtration unit 45. A circulation pump 43 sends the water collected from tray 70 back to the reservation tank 50 where water is stored to be reused.

In an embodiment of the present invention, the water in the tank is heated by an electrical water heater 52. The water is then sent to the high pressure discharge pump 55 which pumps the water through a high pressure hose 57 to the nozzles 4 and discharges pressurized water 2 onto the fabric sheet 28.

The roller 20 is attached to the extended arms 30 that are connected to the main unit. In an embodiment of the present invention, the roller may be a spongy roller. The spongy roller offers cushion contact with the facades surface and improves cleaning coverage by reaching corners. The arms are fixed to the main unit frame with a retractable mechanism.

In an embodiment of the present invention, the extended arms 30 are retractable to allow the machine to avoid obstacles like an open window or a minor structural outcrop while continuing to perform the cleaning job.

The invention claimed is:

1. An apparatus configured to clean a facade while moving along a building and using a recirculation cleaning system, the apparatus comprising:

a structural frame;

a thrust provider for generating force to keep the apparatus in contact with the facade;

a close loop circuit of fabric sheet to wipe clean the facade;

a high pressure water pump that discharges pressurized cleaning liquid into the fabric sheet via spraying nozzles;

squeezing rollers where the fabric sheet runs in-between the rollers to extract cleaning liquid from the sheet;

a collecting tray placed underneath the squeezing rollers and the spraying nozzles to gather squeezed and sprayed cleaning liquid;

a reservation water tank that supplies cleaning liquid to the high pressure water pump;

a filtration unit to filter cleaning liquid gathered by the collecting tray wherefrom a small water pump sends it to the reservation water tank;

retractable arms that extend towards the façade to put the fabric sheet in contact with façade;

a hoist unit to provide vertical movement for the apparatus; and a wire rope suspending the apparatus from the top of building.

2. The apparatus as claimed in claim 1, wherein the frame is a structural chassis configured for moving along the façade of the building.

3. The apparatus as claimed in claim 1, wherein the thrust provider is a fan discharging a mass of air flow in a direction opposite to the façade.

4. The apparatus as claimed in claim 1, wherein the fabric sheet collects particles from the façade and the particles are removed from the fabric sheet by the pressurized cleaning liquid discharged from the spraying nozzles.

5. The apparatus as claimed in claim 1, wherein the close loop fabric sheet runs between the squeezing rollers to provide pulling force to move the sheet and to squeeze out the cleaning liquid and impurities entrained during facade cleaning.

6. The apparatus as claimed in claim 1, wherein the close loop fabric sheet collects dust, sand, dirt, and smaller particles from the facade.

7. The apparatus as claimed in claim 1 further comprising the hoist unit and at least two wire ropes to move the apparatus vertically along the façade of the building.

8. The apparatus as claimed in claim 1 further comprising a computer for controlling motion and cleaning operations of the apparatus.

9. The apparatus as claimed in claim 1, wherein the retractable arms allow the apparatus to avoid obstacles during facade cleaning.

10. The apparatus as claimed in claim 1, wherein the facade includes windows, panes, marble, any smooth surface and frames.

11. The apparatus as claimed in claim 1, wherein the building includes residential apartments, towers, multiplexes, office buildings and other structures.

12. The apparatus as claimed in claim 1, wherein cleaning liquid from the filtration unit is sent to the reservation water tank to store and reuse the cleaning liquid.

13. The apparatus as claimed in claim 12, wherein the cleaning liquid is heated by an electrical water heater.

14. The apparatus as claimed in claim 1, wherein one of the squeezing rollers is driven by an electrical gear-motor.

* * * * *